United States Patent [19]

Hirata et al.

[11] 4,206,667

[45] Jun. 10, 1980

[54] TOOL HOLDING APPARATUS FOR PRESSES

[75] Inventors: Tadashi Hirata, Yamato; Takashi Nakano, Sagamihara, both of Japan

[73] Assignee: Amada Company, Limited, Isehara, Japan

[21] Appl. No.: 938,594

[22] Filed: Aug. 31, 1978

[30] Foreign Application Priority Data

Aug. 31, 1977 [JP] Japan ..... 52-103534

[51] Int. Cl.[2] ..... B26D 7/06; B26D 7/26; B26F 1/02

[52] U.S. Cl. ..... 83/146; 83/171; 83/698

[58] Field of Search ..... 83/698, 146, 171

[56] References Cited

U.S. PATENT DOCUMENTS

| | | | |
|---|---|---|---|
| 1,646,851 | 10/1927 | Campbell | 83/146 X |
| 1,723,106 | 8/1929 | Wiglenda | 83/146 |
| 3,495,493 | 2/1970 | Herb et al. | 83/698 |
| 3,613,491 | 10/1971 | Kahmann | 83/146 |
| 3,719,117 | 3/1973 | Mauk et al. | 83/698 |
| 3,779,122 | 12/1973 | Sawvell | 83/698 |
| 3,831,483 | 8/1974 | Beauplat | 83/698 |
| 3,845,680 | 11/1974 | Scott et al. | 83/146 |

*Primary Examiner*—Frank T. Yost

*Attorney, Agent, or Firm*—Thompson, Birch, Gauthier & Samuels

[57] ABSTRACT

A press is disclosed having an upper tool which is vertically reciprocated by means of a ram and which is arranged to cooperate with a stationary lower tool in performing work on a workpiece positioned therebetween. The press is characterized by improved apparatus for detachably mounting the upper and lower tools, as well as by an improved apparatus for limiting upward movement of the workpiece during upward retraction of the upper tool.

9 Claims, 9 Drawing Figures

TOOL HOLDING APPARATUS FOR PRESSES

BACKGROUND OF THE INVENTION

1. Field of the Invention

The present invention relates generally to presses such as punch presses having an upper tool and a lower tool for processing sheet metals and other like workpieces and more particularly pertains to an improved tool holding apparatus for such presses whereby the tools can be positively held and easily attached and detached.

2. Description of the Prior Art

In presses such as punch presses for processing sheet metal and the like, the upper and lower tools have been held heretofore in various manners, but all of the conventional tool holding arrangements have had several inherent disadvantages. For example, in one conventional arrangement where an upper tool is held on a press by a collet means, it is difficult and troublesome to attach and detach the tool from the press. In another conventional arrangement where an upper tool is fixed to a press by a screw means, the upper tool cannot be securely held in place and is prone to loosen or detach itself from the press when it is stripped from a workpiece such as thick sheet metal after working the same. Also, in another conventional arrangement, an upper tool is formed with a flange to be held by a holding member which is in turn actuated by a suitable means such as a hydraulic motor. In this arrangement, the upper tool can be securely held and easily attached and detached, but such a tool holding apparatus is of course complicated and therefore costly. There have been problems also in holding the lower tools and there have been no means that meet all requirements for not only positively holding tools on presses but also easily attaching and detaching them onto and from presses.

SUMMARY OF THE INVENTION

It is an object of the present invention to provide a tool holding apparatus for presses in which upper and lower tools can be positively held.

It is another object of the present invention to provide a tool holding apparatus for presses in which upper and lower tools can be easily attached and detached.

It is a further object of the present invention to provide a tool holding apparatus for presses which is simple in construction, and which enables the upper and lower tools not only to be positively held but also to be easily attached and detached.

Other and further objects and advantages of the present invention will be apparent from the following description and accompanying drawings which, by way of illustration, show a preferred embodiment of the present invention and the principles thereof.

DESCRIPTION OF THE PREFERRED EMBODIMENT

Figure 1:
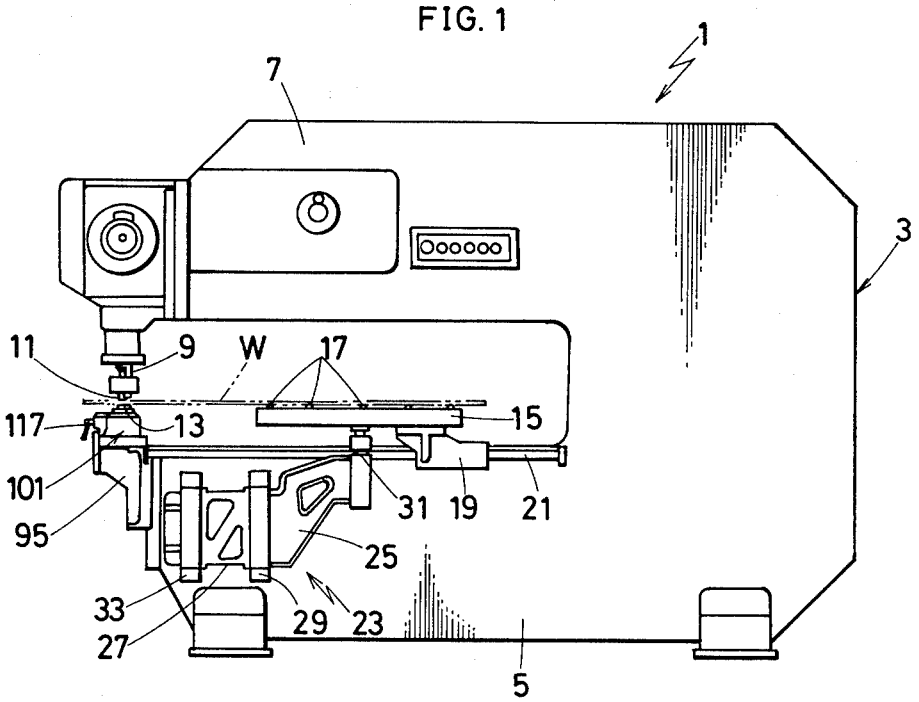
FIG. 1 is a side elevation of a punch press in which an apparatus according to the present invention is incorporated.

Referring now to FIG. 1, the present invention will be described in connection with a punch press of the type generally designated by the numeral 1. It will be understood, however, that the present invention is not limited in application to this particular type of punch press, and that it has broad applicability to a variety of press designs for processing sheet metals and the like.

As is conventional, the punch press 1 is constructed with a C-shaped frame 3 having a base 5 and an overhead assembly 7, and it has a ram 9 which is provided at the front end of the overhead assembly 7 so as to be vertically reciprocated by a drive means enclosed in the overhead assembly 7. The punch press 1 is also conventional in that it has an upper tool 11 detachably fixed at the lower end of the ram 9 and a lower tool 13 detachably fixed at the front end of the base 5 so as to cooperate with the upper tool 11. Also, the punch press 1 is provided with a worktable 15 which is mounted on the base 5 so that a workpiece W such as a piece of sheet metal may be placed thereon for processing by the upper and lower tools 11 and 13. The workpiece 15 may be provided at its top surface with a plurality of rollers or balls 17 so that the workpiece may be free to be moved thereon. However, the worktable 15 is not always necessary and may be omitted in some types of machine, and also the worktable 15 may either be fixed or movable, depending on the types of machine.

In the preferred embodiment, however, the worktable 15 is slidably mounted on the base 5 so that it may be moved toward and away from the upper and lower tools 11 and 13. For this purpose, the worktable 15 is provided at its underside with a pair of laterally arranged slide members 19, only one of which is seen in FIG. 1, while the base 5 is provided at its top with a pair of guide rails 21 so that the slide members 19 may slide thereon. It will be understood that the guide rails 21 are fixed on the top of the base 5 in parallel with each other, although only one of them is seen in FIG. 1. Also, the worktable 15 in the preferred embodiment is movably supported not only by the slide members 19 but also by a pair of hinge-like supporting arms 23 which are provided on both sides of the base 5, since the worktable 15 is much larger in width than the top of the base 5 and overhangs horizontally on both sides of the base 5. Each of the swinging supporting arms 23 comprises a pair of swinging supporting members 25 and 27 which are pivotally coupled with each other by a pin member 29 in the manner of a door hinge. The swinging member 25 is pivotally connected with a pin member 31 which is vertically journaled at the underside of the respective slide member 19, while the swing member 27 is pivotally connected with another pin member 33 provided at the side of the base 5. Thus, the hinge-like supporting means 23 will always hold the overhanging portions of the worktable 15 but they will enable the whole worktable 15 to move toward and away from the upper and lower tools 11 and 13, since the swing supporting members 25 and 27 will be swung about the pins 29, 31 and 33 as the worktable 15 is moved.

Figure 2:
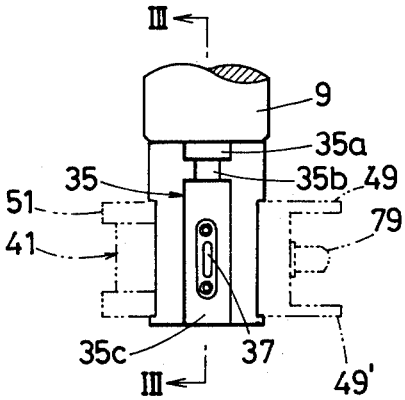
FIG. 2 is a partial elevation showing a portion by the punch press shown in FIG. 1.
Figure 3:
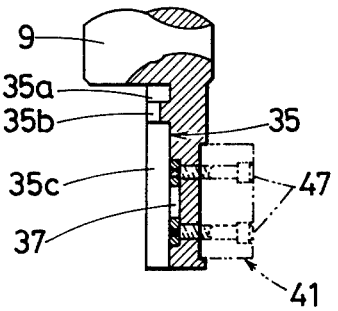
FIG. 3 is a sectional view taken along the plane III—III of FIG. 2.
Figure 6:
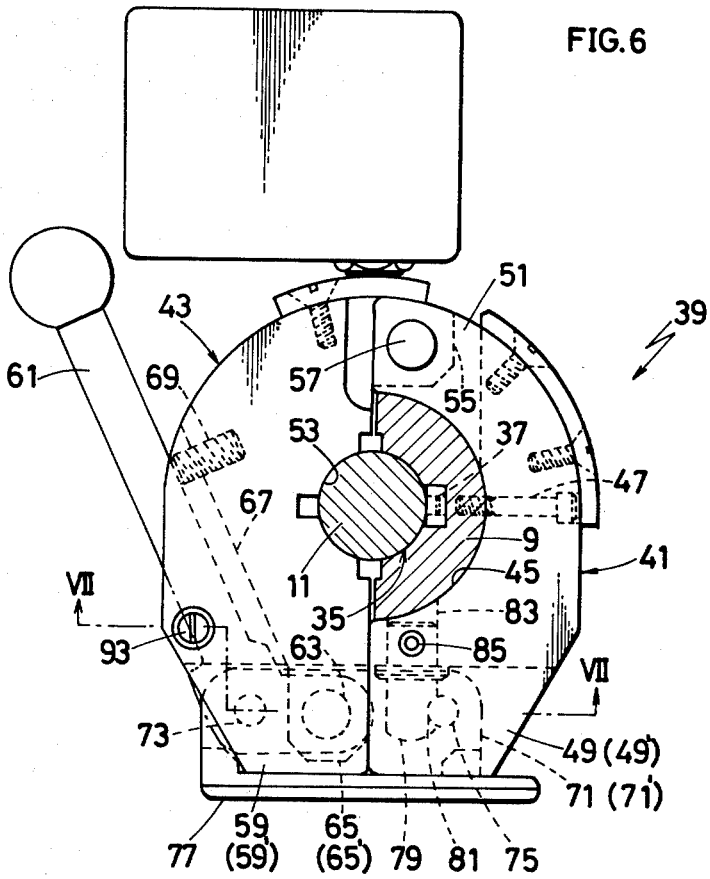
FIG. 6 is a partial plan view showing a portion of the punch press shown in FIG. 1 with a portion in section taken along the plane VI—VI of FIG. 5.

Referring to FIGS. 2 and 3, the lower end of the ram 9, where the upper tool 11 is held, is cut away along a vertical plane passing through the axial center of the ram 9, and it is so formed as to be semicylindrical, or semicircular in cross section, as best shown in FIG. 6. Also, the lower semicylindrical portion of the ram 9 is formed at its flat side with "first" tool holding cavity 35 where the upper tool 11 is to be put. In this connection, the upper tool 11 is provided at its top end with a mushroom-shaped adjusting screw 11*s* which is provided for adjusting the length of the upper tool 11 and is locked at the top of the upper tool 11 by a locking nut 11*n*. Accordingly, in order to hold the upper tool 11 of such a shape or construction, the first tool holding cavity 35 is particularly so formed as to comprise three semicylindrical cavities 35*a*, 35*b* and 35*c* which communicate vertically with each other. More particularly, the upper cavity 35*a* is short but large in radius to hold the head portion of the adjusting screw 11*s*, the middle cavity 35*b* is smaller in radius and the lower cavity 35*c* is long and large in radius to accommodate the body of the upper tool 11. Also, the first tool holding cavity 35 is so formed as to be coaxial with the semicylindrical portion of the ram 9 and extends from the top extreme end to the lower extreme end of the same portion. Furthermore, in order to physically position the upper tool 11 in the first tool holding cavity 35 and prevent the same from rotating therein, the lower cylindrical cavity 35*c* may be formed with a groove 37 in which a key on the upper tool 11 may be received. Thus, a portion of the upper tool 11 is received in the first tool holding cavity 35 with the top of the adjusting screw 11*s* held in contact with the center of the lower end of the non-semicylindrical portion of the ram 9 so that it may be fully urged into the workpiece W by the ram 9. Thus, axial tool loads experienced by upper tool 11 during operation of the press are transmitted directly to the ram 9 via the adjusting screw 11*s*. Also, it will be understood that the upper tool 11 will be prevented from being pulled out of the first tool holding cavity 35 when stripped from the workpiece W after processing the same, since the mushroom portion of the adjusting screw 11*s* of the upper tool 11 is held in the upper semicylindrical portion 35*a* of the tool holding cavity 35.

Referring especially to FIGS. 4 to 7 inclusive, the upper tool 11 is held in the first tool holding cavity 35 at the semicylindrical lower end of the ram 9 by a tool holding assembly which is generally designated by the numeral 39 and which is also fixed at the semicylindrical end of the ram 9. The tool holding assembly 39 comprises a fixed "first" holding block 41 and swingable "second" holding block 43 which are substantially equal in length and thickness and are horizontally disposed at the semicylindrical lower end of the ram 9 to cooperate with each other to hold the upper tool 11. As seen from FIG. 6, the fixed holding block 41 is formed at its central side with a semicylindrical cavity 45 in which the semicylindrical lower end of the ram 9 is to be engaged, and it is fixed to the same portion of the ram 9 by tightening means such as bolts 47.

Figure 7:
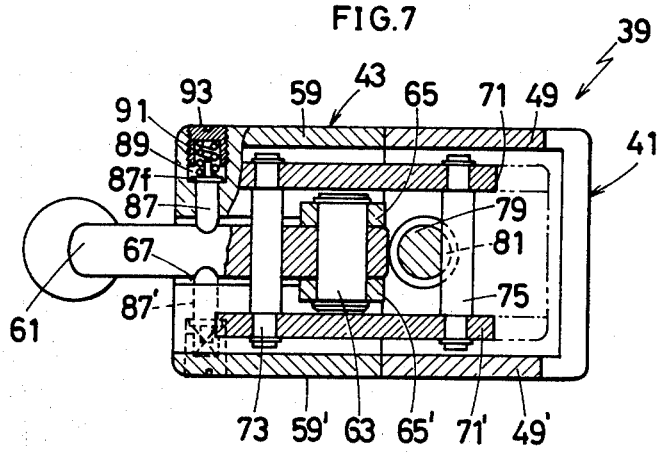
FIG. 7 is a sectional view taken along the plane VII—VII of FIG. 6.

As seen from FIGS. 6 and 7, the fixed holding block 41 is provided at one end thereof with a pair of horizontally projecting flanges 49 and 49′, and it is also provided at its other end with another pair of horizontally projecting flanges 51. Also, the swingable holding block 43 is formed at its central side portion with a semicylindrical "second" cavity 53 in which another portion of the cylindrical upper tool 11 is to be accommodated as best shown in FIG. 6. The swingable holding block 43 is provided at one end thereof with a horizontal projection 55, and it is horizontally swingably connected to the flanges 51 of the fixed holding block 41 by a vertical pin 57 so that it may pivot thereon. More particularly, the horizontal projection 55 of the swingable holding block 43 is so formed as to horizontally project into between the flanges 51 of the fixed holding block 41, and the vertical pin 57 is so disposed as to vertically pass through the flanges 51 and the projection 55. Also, the swingable holding block 43 is provided at its end opposite to the projection 55 with a pair of horizontally projecting flanges 59 and 59′ projecting to the same extent as the flanges 49 and 49′ of the fixed holding block 41. Thus, it will now be understood from the above description that the upper tool 11 is held at the lower end of the ram 9 when the swingable end of the holding block 43 is held in contact with the fixed holding block 41. At this position, the upper tool is firmly held within both cavities 45 and 53. Also, it will be understood that the upper tool 11 can be detached from the ram 9 when the swingable holding block 43 is swung away from the fixed holding block 41 around the vertical pin 57.

In order to releasably lock the swingable holding block 43 to the fixed holding block 41, a locking lever 61 is horizontally pivotally provided so as to pivot about a pin 63 which is vertically disposed between a pair of projections 65 and 65′ horizontally formed on the swingable holding block 43. As seen from FIGS. 4, 6 and 7, the projections 65 and 65′ extend horizontally from the swingable holding block 43 between the flanges 59 and 59; of the swingable holding block 43. The swingable holding block 43 is formed at its outer side with a horizontal cavity 67 arranged to receive the lever 61. Also, a stop pin member 69 is provided in the horizontal cavity 67 of the swingable holding block 43 so as to stop and position the lever 61 therein.

Figure 4:
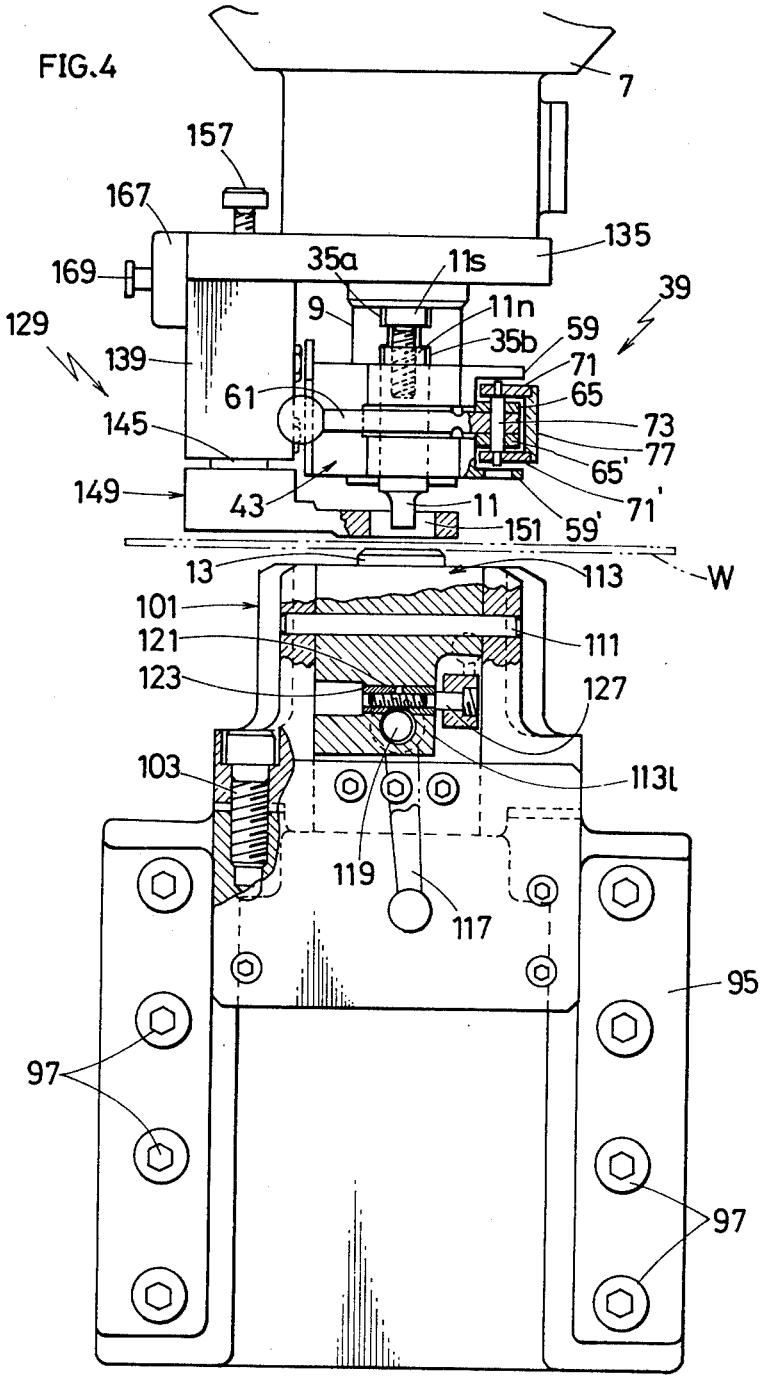
FIG. 4 is a partial front elevation of the punch press shown in FIG. 1 with portions broken away.

As shown in FIGS. 4, 6 and 7, a pair of elongated flat links 71 and 71; which are equal in length, are horizontally pivotally connected to the lever 61 by a pin member 73 which extends vertically through the lever 61. The links 71 and 71′ are also integrally connected to each other by an external vertical plate member 77 which also serves as a cover. An additional locking pin 74 extends vertically between and is pivotally connected to both links 71, 71′. The locking pin 75 can be rotated or swung together with the links 71 and 71′ about the pin member 73.

As shown in FIGS. 6 and 7, a locking member 79 is so provided at the fixed holding block 41 as to horizontally project therefrom between the flanges 49 and 49′ of the fixed holding block 41. The locking member 79 is formed on its side opposite to the swingable holding block 43 with a vertical notch 81 with which the locking pin 75 can be engaged. In the preferred embodiment, the locking member 79 is inserted in a horizontal bore 83 formed through the fixed holding block 41 and it is fixed therein by a pin member 85. Also, the locking pin 75 and the locking member 79 are so located with regard to each other than the locking pin 75 may fittingly engage with the notch 81 of the locking member 79 when the swingable holding block 43 is put in contact with the fixed holding block 41 and also the lever 61 is received in the cavity 67 of the swingable holding block 43 in contact with the stop pin member 69. Thus, it will be now understood that the upper tool 11 is held in the tool holding cavity 35 at the lower end of the ram 9 and the cavity 53 on the swingable holding block 43 when the locking pin 75 is engaged with the notch 81 of the locking member 79 and the locking lever 61 is received in the cavity 67 of the swingable holding block 43 in contact with the stop pin member 69 as shown in FIG. 6.

As best shown in FIG. 7, in order to hold the locking lever 61 in the cavity 67 of the swingable holding block 43, a pair of pin members 87 and 87; each having rounded ends are symmetrically disposed on the both sides of the cavity 67 so that they may vertically project thereinto. Each of the pin members 87 and 87′ is vertically slidably inserted in a vertical bore 89 formed through the swingable holding block 43, and it is biased to be projected into the cavity 67 by a spring 91 which is confined by a screw member 93 closing the outer end of the bore 89. More particularly, each of the pin members 87 and 87′ has a flange 87*f* which is to be biased by the spring 91, and the outer portion of the bore 89 is enlarged so as to enable the flange 87*f* to slide therein and is formed with a thread with which the screw member 93 engages. Thus, the pin members 87 and 87′ are normally kept projecting into the cavity 67 of the swingable holding block 43, and the lever 61 can be held in the cavity 67 in contact with the stop pin member 69 as shown in FIG. 6. However, it will be understood that the pin members 87 and 87′ are retracted into the bores 89 of the swingable holding block 43 against the springs 91 when the lever 61 is swung or rotated therebetween by hand.

As will now be understood from the above description, when it is desired to detach the upper tool 11 which is held at the lower end of the ram 9 as shown in FIG. 6, the locking lever 61 is firstly pulled and swung away from the stop pin member 69 of the swingable holding block 43 around the pin 63. As is readily apparent, the links 71 and 71′ will be moved by the lever 61 to disengage the locking pin 75 from the notch 81 of the locking member 79 when the lever 61 has been rotated about the pin 63 around a certain angle. After the locking pin 75 has been disengaged from the notch 81 of the locking member 79, the locking pin 75 is swung away from the locking member 79 together with the links 71 and 71′ around the pin member 73 and then the swingable holding block 43 is swung about the pin 57 away from the fixed holding block 41. The upper tool 11 then can be easily detached from the lower end of the ram 9. Attaching the upper tool to the ram merely involves reversing the above sequence of operations.

The present invention also provides means for detachably mounting the lower tool 13. To this end, a support frame 95 is fitted on the front of the base 5 of the C-shaped frame 3 by bolts 97 and a key 99. On the support frame 95 is fixed a lower tool supporting member 101 by bolts 103. The lower tool supporting member 101 has top surface with a circular cavity 105 (see FIG. 9) arranged to receive the lower tool 13. A positioning key 107 is fixed on the lower tool supporting member 101. The positioning key 107 positions the direction of the lower tool 13 as a die. Where the lower tool 13 has a relatively small diameter, a die support ring or bushing 109 may be employed. As hereinafter employed, the term "lower tool" is intended to encompass said bushing 109 and/or said smaller diameter tool 13. The circular cavity 105 formed on the lower tool supporting member 101 is dimensioned to receive the lower tool 13. On the lower tool supporting member 101, access grooves 101*a* and 101*b* (see FIG. 9) are formed radially, enabling an operator to easily remove the lower tool fitted in the circular cavity 105.

In order to fix the lower tool firmly in the circular cavity 105 of lower tool supporting member 101, a locking arm 113 is pivoted by a horizontal pin 111 to allow free pivoting on the front side of lower tool supporting member 101. The locking arm 113 is somewhat L-shaped, with an upper segment 113*u* extending horizontally toward the lower tool. At the end of the upper segment 113*u*, a V-shaped notch 115 (see FIG. 9) is formed, to be engaged with the circumference of the lower tool. The lower segment 113*l* of locking arm 113 extends downwardly and is provided, near its lower end, with an adjustment screw 119 operated by a lever 117. The tip of the adjustment screw 119 is in contact with the lower tool supporting member 101.

Figure 5:
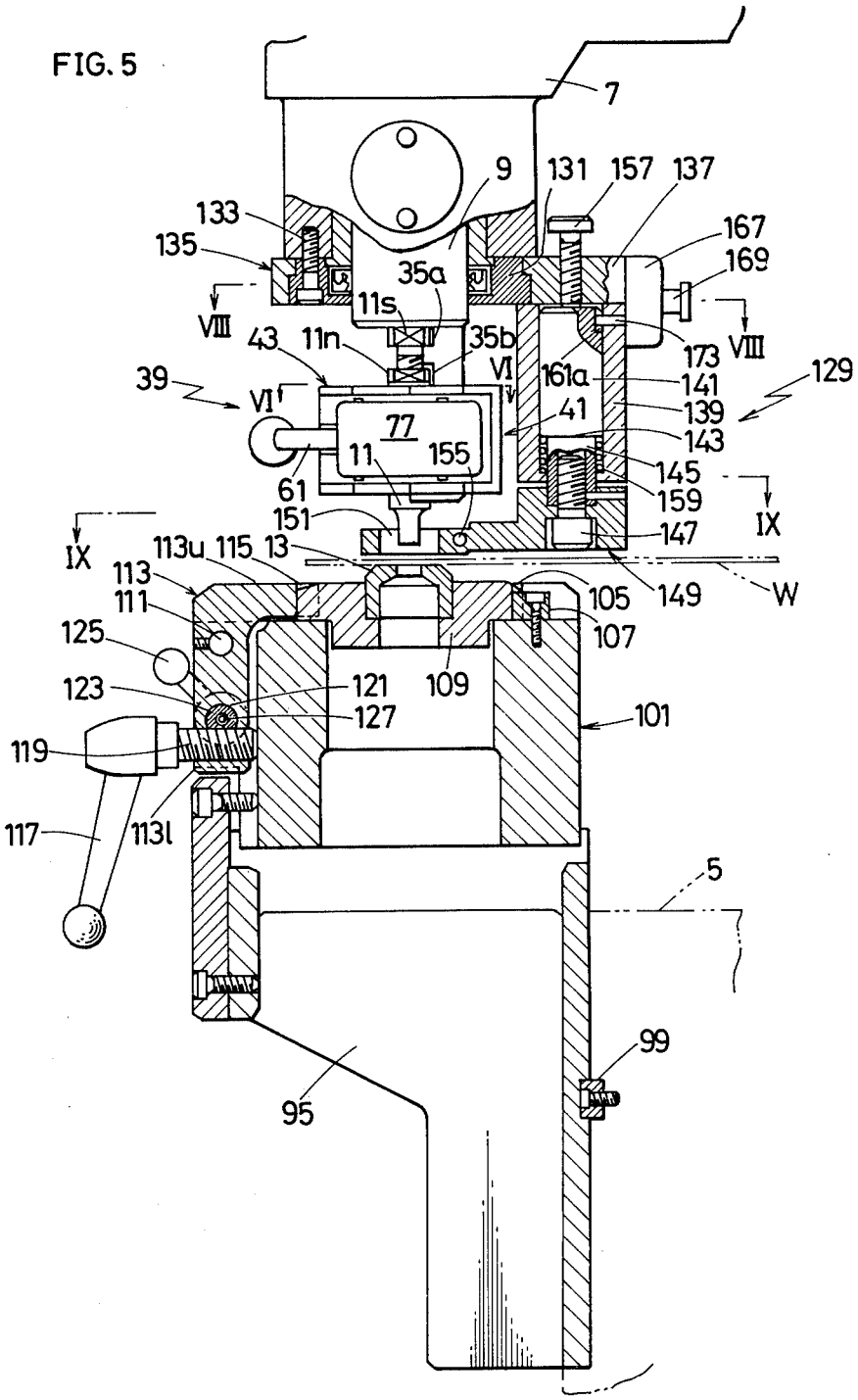
FIG. 5 is a partial side elevation of the punch press shown in FIG. 1 with portions broken away and shown in section and with a portion shown as moved from the status shown in FIG. 4.

From the above description it will be understood that tightening the screw 119 rotates the locking arm 113 clockwise as viewed in FIG. 5, so that the upper arm segment 113*u* presses the lower tool toward the positioning key 107, to fix the lower tool firmly to the lower tool supporting member 101. By the same token, loosening the screw 119 releases the lower tool.

To prevent the screw 119 from inadvertently loosening, a through hole 121 perpendicular to the screw 119 is provided in the lower segment 113*l* of locking arm 113, and a locking nut 123 is inserted in the through hole 121. A bolt 127 with a lever 125 at the end is screwed in the locking nut 123. Therefore, if the bolt is turned by the lever 125, the locking nut 123 slides sideways as viewed in FIG. 4, to fix or release the screw 119. Thus, the screw 119 can be prevented from being loosened by vibration, etc. during the processing of workpiece W.

Figure 8:
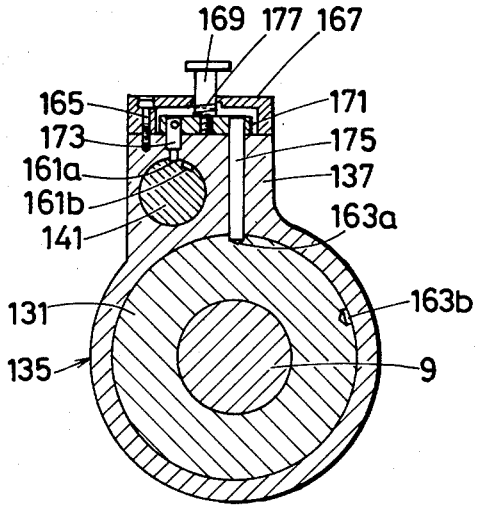
FIG. 8 is a sectional view taken along the plane VIII—VIII of FIG. 5.
Figure 9:
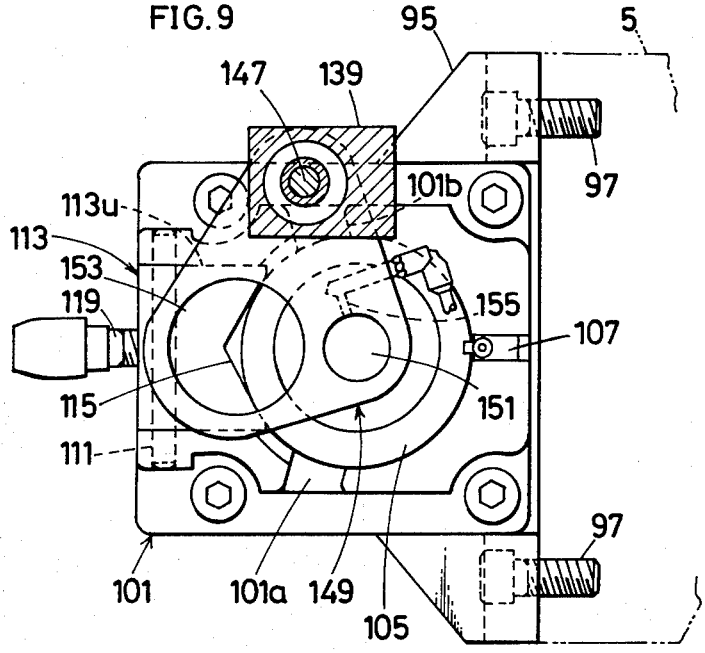
FIG. 9 is a sectional view taken along the plane IX—IX of FIG. 5.

A workpiece retaining means 129 is additionally provided to allow the upper tool 11 to be easily stripped from the workpiece W. As shown in FIG. 5, a ring member 131 surrounds the ram 9 and is attached by a bolt 133 at the front lower end of the overhead assembly 7. The ring member 131 supports a workpiece retaining holder 135 for rotation about the axis of the ram 9. As shown in FIG. 8, the workpiece retaining holder has a laterally extending protrusion 137 with a depending guide pipe 139 (see FIG. 5) containing an axially movable holder pin 141. A step 143 is located at the lower portion of the holder pin 141, and a reduced diameter lower end 145 of the pin extends downward from the step 143. A retaining plate 149 is fixed to the lower end 145 of holder pin 141 by a bolt 147. The workpiece retaining plate 149 is somewhat triangular in shape as shown in FIG. 9, and is provided with large and small punch holes 153 and 151. The small diameter punch hole 151 is used when the upper tool 11 is small in diameter, and the large diameter punch hole 153 is used when the upper tool 11 is large in diameter. The workpiece retaining plate 149 is pivotally mounted to allow the small and large punch holes 151 and 153 to be alternately aligned with the different sized upper tools. In the illustration, the small diameter punch hole 151 is shown operatively positioned in line with the upper tool. The small and large punch holes 151 and 153 are respectively connected to an air port 155 (only the connection to puch hole 151 being illustrated in the drawings) for injecting cooling air to cool the upper tool 11. Furthermore, for adjusting the height of the workpiece retaining plate 149 according to the thickness of workpiece W, an adjust bolt 157 is screwed in the protrusion 137 of workpiece retaining holder 135, with its lower end in contact with the top of the holder pin 141, and a spring 159 acting to raise the holder pin 141 is provided between the step 143 of holder pin 141 and the bottom of guide pipe 139.

It will be understood from the above description that tightening the adjust bolt 157 presses down the holder pin 141 against the force of spring 159, thereby adjusting the workpiece retaining plate 149 downward. Loosening the adjust bolt 157 allows the holder pin 141 to be pushed up by the action of spring 159, thereby adjusting the workpiece retaining plate 149 upwardly. Thus, the height of workpiece retaining plate 149 can be adjusted according to the thickness of workpiece W. In addition, cooling air is injected from the air port 155 into the punch hole 151 or 153, to cool and thus extend the useful life of the upper tool 11.

To index the small or large punch hole 151 or 153 of the workpiece retaining plate 149 according to the size of upper tool 11, indexing grooves 161*a* and 161*b* are provided on the upper circumferential face of the holder pin 141 (see FIG. 8). In addition, to index the workpiece retaining holder 135 properly around the ring member 131, indexing holes 163*a* and 163*b* are provided also on the circumferential face of ring member 131. At the tip of the protrusion 137 of workpiece retaining holder 135, a bracket 167 is solidly fitted by a bolt 165, and supports an axially movable knob 169. A plate 171 fixed to the end of knob 169 has indexing pins 173 and 175 protruding therefrom. The tip of indexing pin 173 can be freely engaged with or disengaged from the indexing grooves 161*a* or 161*b* provided on the holder pin 141, while on the other hand, the tip of indexing pin 175 can be freely engaged with or disengaged from the indexing holes 163*a* or 163*b* provided on the circumferential face of the ring member 131. A spring 177 is provided between the bracket 167 and the plate 171.

Therefore, pulling the knob 169 against the force of spring 177 extracts the respective indexing pins 173 and 175, making the tip of indexing pin 173 come out of the indexing groove 161*a* and the tip of other indexing pin 175 come out of the indexing hole 163*a*. Therefore, when the knob 169 is pulled against the force of spring 177, the holder pin 141 is in a position to pivot freely, and the workpiece retaining holder 135 is in a position to rotate freely around the ring member 131. Thus, by rotating the workpiece retaining plate 141, to make the indexing pin 173 engaged with the indexing groove 161*b* of holder pin 141, the small or large hole 151 or 153 of workpiece retaining plate 149 can be properly selected according to the upper tool 11. And by rotating the workpiece retainer holder 135 properly around the ring member 131, to make the indexing pin 175 engaged with the other indexing hole 163*b*, the guide pin 139, etc. of workpiece retaining means 129 can be positioned away from a position inconvenient for exchange work of upper tool 11.

It will thus be seen that the present invention facilitates the prompt exchange of the upper tool on the ram and the firm fixing of the upper tool. It also allows the prompt exchange of the lower tool. Furthermore, since the workpiece retaining plate of workpiece retaining means can be adjusted vertically according to the thickness of workpiece, engagement of the workpiece during processing can be avoided. In addition, since the upper tool is cooled by the cooling air injected into the punch hole of workpiece retaining plate, overheating of the upper tool is prevented.

Although a preferred form of the present invention has been illustrated and described, it should be understood that the device is capable of modification by one skilled in the art without departing from the principles of the invention. Accordingly, the scope of the invention is to be limited only by the claims appended hereto.

We claim:

1. For use with a press having an upper tool which is vertically reciprocated by means of a ram and which is arranged to cooperate with a stationary lower tool in performing work on a workpiece positioned therebetween, apparatus for detachably mounting the upper tool on the ram, comprising: a first cavity on the ram for receiving a portion of the upper tool, a first block member fixed relative to the ram, a second block member having a second cavity for receiving another portion of the upper tool, said second block member being pivotally mounted on said first block member for movement between a closed position at which the upper tool is fixed relative to the ram within both said first and second cavities, and an open position permitting removal of said upper tool from said ram, and locking means for maintaining said second block member in said closed position.

2. The apparatus of claim 1 wherein said locking means is comprised of a locking lever pivotally mounted on said second block, a locking pin pivotally connected to said locking lever by link means extending therebetween, a fixed locking member on said first block member, said locking lever being pivotally adjustable between an unlocked position at which said locking pin is disengaged from said fixed locking member and said second block member is free to pivot relative to said first block member, and a locked position at which said locking pin is engaged with said locking member and said second block member is held in said closed position.

3. The apparatus of claim 2 further comprising resiliently disengageable means for holding said locking lever in said locked position.

4. The apparatus in accordance with claims 1, 2 or 3 including means for detachably mounting the lower tool on a stationary portion of the press, said means comprising: a lower tool supporting member having an upwardly facing cavity dimensioned to receive the lower tool therein, a locking arm mounted on said lower tool supporting member for pivotal movement about an axis, said locking arm having one segment arranged to extend into said cavity, and adjustment means acting on another segment of said locking arm to pivot said locking arm about said axis in order to urge said one segment against a lower tool in said cavity.

5. The apparatus of claim 4 wherein said adjustment means includes a manually adjustable screw threaded through said other segment and arranged to engage said lower tool supporting member.

6. The apparatus in accordance with claims 1, 2 or 3 further comprising means for limiting upward movement of the workpiece during upward movement of the upper tool, said means comprising: a workpiece retaining holder operatively positioned between said upper and lower tools at a location overlying the workpiece, said retaining holder having at least one aperture through which the upper tool may be reciprocated, and adjustment means for vertically adjusting the position of said retaining holder to accommodate varying workpiece thicknesses.

7. The apparatus of claim 6 wherein said workpiece retaining holder is provided with a plurality of said apertures of different sizes to accommodate different sized upper tools, and means for adjusting said retaining holder in a horizontal plane to align said apertures with said upper tools.

8. The apparatus of claim 7 wherein said workpiece retaining holder is rotatably adjustable about the axis of said ram.

9. The apparatus of claim 6 further comprising means for injecting air into said aperture to cool the upper tool being reciprocated therethrough.

* * * * *